US005638900A

United States Patent [19]

Lowenstein et al.

[11] Patent Number: 5,638,900

[45] Date of Patent: Jun. 17, 1997

[54] HEAT EXCHANGE ASSEMBLY

[75] Inventors: Andrew Lowenstein; Marc J. Sibilia, both of Princeton, N.J.

[73] Assignee: AIL Research, Inc., Princeton, N.J.

[21] Appl. No.: 379,132

[22] Filed: Jan. 27, 1995

[51] Int. Cl.[6] ..... F28F 3/12

[52] U.S. Cl. ..... 165/168; 165/153; 165/167; 165/177; 165/183

[58] Field of Search ..... 165/153, 148, 165/165, 183, 170, 177, 168, 167, 176

[56] References Cited

U.S. PATENT DOCUMENTS

| | | | |
|---|---|---|---|
| 2,981,520 | 4/1961 | Chadburn | 165/170 |
| 3,327,776 | 6/1967 | Butt | 165/170 X |
| 3,486,489 | 12/1969 | Huggins | 165/177 X |
| 3,543,844 | 12/1970 | Bellemead et al. | 165/165 X |
| 4,002,200 | 1/1977 | Raskin . | |
| 4,156,419 | 5/1979 | Lewis, Sr. . | |
| 4,270,602 | 6/1981 | Foster | 165/167 |
| 4,898,153 | 2/1990 | Sherwood . | |
| 4,945,981 | 8/1990 | Joshi | 165/166 X |
| 5,170,319 | 12/1992 | Chu et al. . | |
| 5,203,407 | 4/1993 | Nagasaka . | |
| 5,417,280 | 5/1995 | Hayashi et al. | 165/153 |

FOREIGN PATENT DOCUMENTS

| | | | |
|---|---|---|---|
| 3803599 | 8/1989 | Germany | 165/176 |

*Primary Examiner*—Leonard R. Leo
*Attorney, Agent, or Firm*—Watov & Kipnes, P.C.

[57] ABSTRACT

A heat exchange assembly including at least one plate, preferably made from profile board, having a plurality of channels therein for the flow of a heat exchange fluid in a first plane which may be flat or curved and at least one inlet and outlet angled up to 90° with respect to the first plane.

14 Claims, 7 Drawing Sheets

HEAT EXCHANGE ASSEMBLY

FIELD OF THE INVENTION

The present invention is generally directed to a heat exchanger assembly in which one plate, and in some applications at least two stacked, spaced-apart plates, each containing a plurality of channels for the passage of a first heat exchange fluid, has an inlet and outlet angled with regard to the direction of flow of said first heat exchange fluid. The present heat exchangers can be made from low-cost corrosion-resistant materials such as profile board.

BACKGROUND OF THE INVENTION

Profile board or profile sheets are spaced apart double-walled boards of plastic or metal which are kept a fixed distance apart by webs that connect the walls. The presence of the webs define a plurality of passages or channels between the boards through which a fluid may flow. An example of the use of profile board and further details of its construction are disclosed in Daniel A. Sherwood, U.S. Pat. No. 4,898,153, incorporated herein by reference.

Heat exchangers have been made from profile board. The boards are stacked in spaced apart relationship by spacers which separate adjacent boards. The space between adjacent boards provides a flow path for a heat exchange fluid.

Such heat exchangers are designed to exchange heat between two gas streams that flow perpendicular to each other. A first gas stream flows through the internal passages within the profile board and a second gas stream flows through the passages that are formed between adjacent spaced apart profile boards. Each end of the profile board is open so that the gas stream enters the internal passages through one end of the profile board and leaves the profile board through the opposed end.

Heat exchangers currently made from profile board suffer from several disadvantages. First, such heat exchangers require the respective fluid streams to flow in perpendicular relationship to each other. This arrangement can reduce the efficiency by which heat can be exchanged in some applications. Second, it is difficult and more costly to isolate the respective heat exchanging fluid streams because leakage can occur at the corner seals of the stack of plates. While some heat exchange applications can tolerate some intermixing of the fluid streams (e.g. ventilators in buildings) many applications cannot effectively function in this manner.

Industrial plate-type heat exchangers made without profile board are made from stacks of parallel plates. The plates are made with cut-outs at their respective ends so that internal manifolds are formed when the plates are stacked together. Pipe stubs through which the fluid enters and exits the heat exchanger are attached perpendicularly to the plates at either the front or back of the plate stacks.

These industrial type heat exchangers are disadvantageous because the fluids require complicated gasket and/or seal configurations to isolate the respective heat exchange fluids. In addition single-wall plates customarily used in such industrial-type heat exchangers have a less rigid structure than the profile board and can become misshapen when exposed to different pressures created by the respective fluids. To overcome this problem, the plates of industrial plate heat exchangers are made more rigid (e.g. by stamping them with a pattern of ribs or corrugations).

To the contrary, the webs in the profile board can support tensile loads locally. Thus, if one fluid stream is at relatively high pressure, the profile board heat exchanger could be circuited with this stream within the profile board. The relatively high forces operating to separate the plates would be supported by the webs. In industrial type plate exchangers, these loads are typically supported with heavy end plates linked together with tie bars.

It should be further noted that increasing the thickness of the plate walls is not desirable when the heat exchanger is constructed of plastic. Since plastics have low thermal conductivity, the walls of the heat exchanger must be as thin as possible if a high degree of thermal effectiveness is desired.

Thus, current heat exchangers are deficient because they require complex gaskets and/or seals to prevent intermixing and are typically made of stiff materials, having a high bending modulus so that the plates won't bend under high pressure loads. Stainless steel is an example of a suitable stiff material.

It would therefore be a significant advance in the art of manufacturing heat exchangers to provide a heat exchange device that can maintain the respective heat exchange fluids separate from each other and that can be constructed effectively from low-cost corrosion-resistant materials in a configuration employing relatively thin walls and reduced spacing between the walls.

SUMMARY OF THE INVENTION

The present invention is directed to a heat exchanger assembly employing at least one profile board having an internal manifold for the flow of a first heat exchange fluid therein. A second heat exchange fluid is provided in heat exchange relationship with and without intermixing with the first heat exchange fluid. The heat exchange assembly may therefore be constructed of low-cost, corrosion-resistant materials, such as plastics and the like.

More specifically, the heat exchange assembly of the present invention comprises:

(a) at least one plate, each plate having a first end and an opposed end and comprising a plurality of channels therein for the flow of a first heat exchange fluid in a first plane which can be flat or arcuate; and (b) at least one inlet and outlet for the first heat exchange fluid, said inlet and outlet being angled with respect to the first plane.

When more than one plate is employed, the heat exchange assembly of the present invention comprises:

(a) at least two stacked spaced-apart plates, each plate having a first end and an opposed end and comprising a plurality of channels therein for the flow of a first heat exchange fluid in a first plane which can be flat or arcuate;

(b) at least one inlet and outlet for the first heat exchange fluid, said inlet and outlet being angled with respect to the first plane; and (c) separation means for maintaining the plates in spaced-apart relationship to provide a space between the spaced-apart plates for a second heat exchange fluid or solid in heat exchange relationship with the first heat exchange fluid in a second plane different than the first plane.

BRIEF DESCRIPTION OF THE DRAWINGS

The following drawings in which like reference characters indicated like parts are illustrative of embodiments of the invention and are not intended to limit the invention as encompassed by the claims forming part of the application.

DETAILED DESCRIPTION OF THE INVENTION

The present invention is directed to a heat exchange assembly in which a first heat exchange fluid flows through at least one plate via an internal manifold and is thereby isolated from a second heat exchange fluid or solid in heat exchange relationship therewith. The manifold and channels formed in the plate are made from profile board and therefore can be made from low-cost, corrosion-resistant materials such as plastics.

As used herein the term "profile board" shall mean a double sheet of material, preferably plastic separated by a series of, preferably uniformly spaced ribs or webs which run the full length of the sheet. The spacing between the ribs creates the plurality of channels referred to herein. The construction of the profile board is disclosed in previously referred to U.S. Pat. No. 4,898,153, incorporated herein by reference. Manufacturers of profile board include Corroplast, Primex and General Electric.

Figure 1:
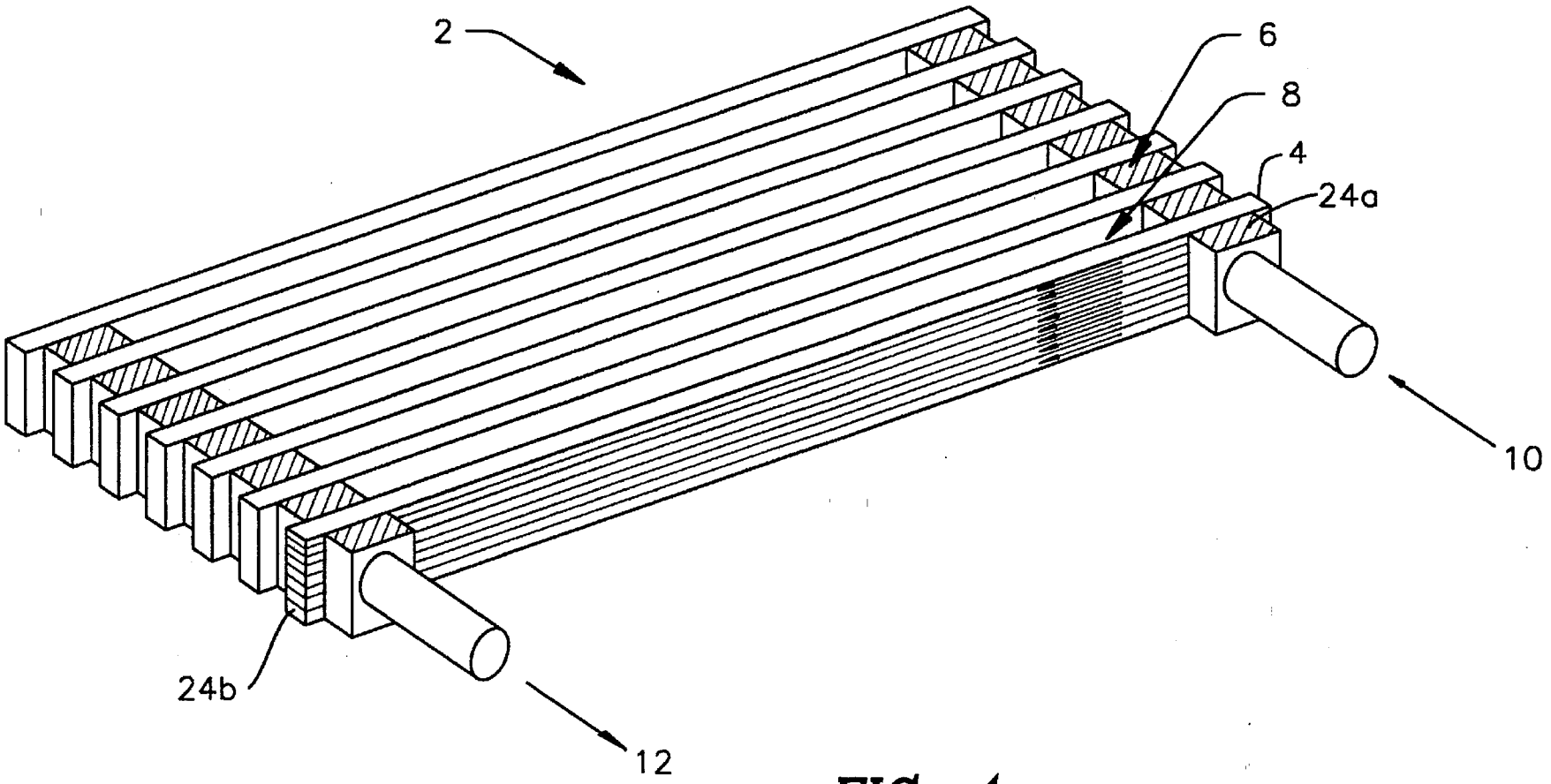
FIG. 1 is a perspective view of a first embodiment of the heat exchange assembly of the present invention with multiple spaced-apart plates and with the inlet and outlet for a first heat exchange fluid at the same side of the heat exchange assembly.

Referring to the drawings and particularly to FIG. 1 there is disclosed a heat exchange assembly 2 including a plurality of stacked plates 4 separated by opposed spacers 6 thereby defining a plurality of external spacings 8 for the stationary presence or flow of a heat exchange medium including fluids and solids. Each of the plates 4 and spacers 6 are aligned and in flow communication, as explained in detail hereinafter, to permit another heat exchange fluid to be present within the respective plates 4 isolated from the heat exchange fluid or solid within or passing through the external spacings 8.

The heat exchange fluid which flows through the plates 4 enters the heat exchange assembly 2 via an inlet 10, and exits the assembly 2 via an outlet 12, each located in this embodiment on the same side of the heat exchange assembly 2. While the first heat exchange fluid flows through the plates 4, the second heat exchange fluid or solid in one embodiment of the invention passes in heat exchange relationship through the flowpaths formed by the external spacings 8. In another embodiment of the invention, the second heat exchange fluid or solid remains stationary in the area formed by the spacings 8.

The inlet 10 and outlet 12 are positioned at an angle with respect to the flow of the first heat exchange fluid as indicated by the arrows. This contrasts with known heat exchangers in which the heat exchange fluid enters the assembly in the same plane as the plates. The angle at which the heat exchange fluid enters and leaves the heat exchanger may be independently chosen up to 90°. As shown in FIG. 1, the inlet 10 and the outlet 12 are positioned perpendicularly (90°) to the flow of the heat exchange fluid. In addition, unlike prior art heat exchange assemblies, the first heat exchange fluid does not enter and leave the plates along the edge thereof. Instead, as discussed more fully below, the first heat exchange fluid enters and leaves the assembly through the inlet 10 and the outlet 12 which are positioned between the respective edges of the plate 4.

The embodiment of the invention specifically shown in FIG. 1 is a single pass heat exchanger in which the heat exchange fluid within the plates 4 travels from one end 24*a* to the other end 24*b*.

Figure 2:
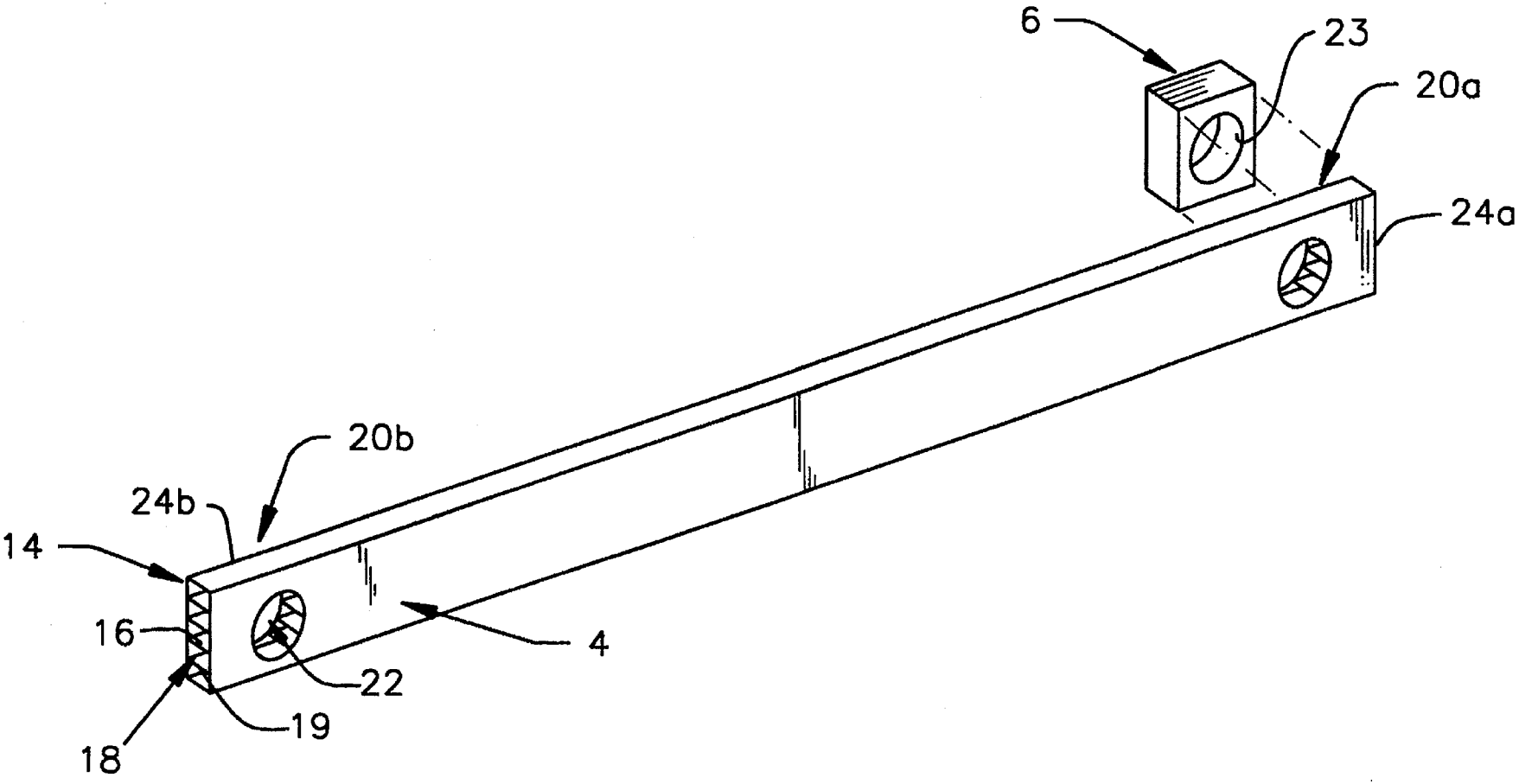
FIG. 2 is a perspective view of one embodiment of a plate having a plurality of channels therein.

The plates 4 employed in the present invention are constructed, for example, in the manner shown in FIG. 2. More specifically each plate 4 is preferably constructed of profile board having outer walls 14 spaced apart by a plurality of internal ribs or webs 16. Each pair of adjacent ribs 16 define a channel 18 therebetween. Upper and lower channels are also formed between the outer wall 14 and the topmost and bottommost ribs, respectively as well. The construction of the profile board is known including the manner in which the ribs 16 are bonded to the walls 14.

Each end portion 20*a*, 20*b* of the plate 4 is provided with an opening 22, preferably circular. The respective openings 22 are contiguous with the inlet 10 and outlet 12 (see, for example, FIG. 1) to enable the first heat exchange fluid to enter and exit the plates 4. The ends 24*a*, 24*b* of the plates 4 are sealed by a sealing means 19 (see FIG. 2) as more fully described below to prevent the first heat exchange fluid from leaving the plates 4. The spacer 6 (when multiple plates are used) is also provided with an opening 23 to permit the heat exchange fluid to travel therethrough into the next plate.

Figure 5:
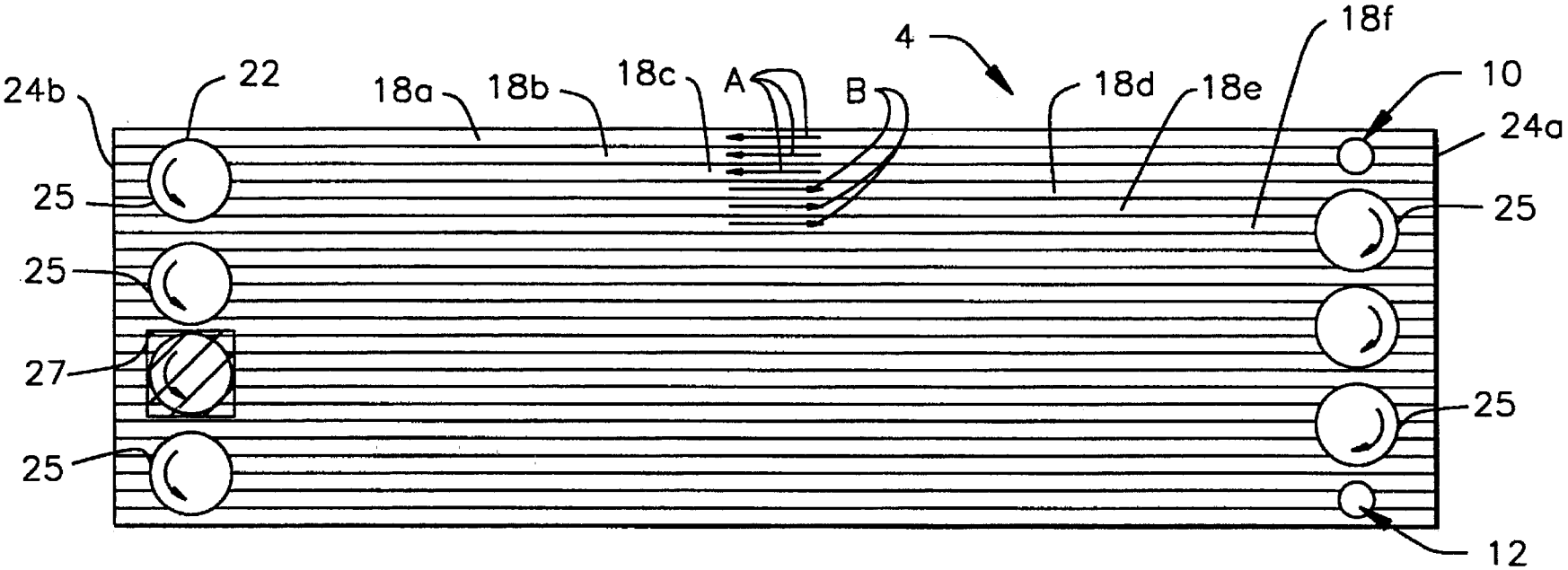
FIG. 5 is a schematic top view of a single plate for use in a heat exchange assembly of the present invention showing the flow of a heat exchange fluid through the channels contained within the plate.

The flowpath of the first heat exchange fluid through a single plate of a multiple pass heat exchanger 4 is shown in FIG. 5. The first heat exchange fluid enters the plate 4 through the inlet 10 and flows through at least one channel 18 in the direction of arrows "A". As shown specifically in FIG. 5, the first heat exchange fluid flows first through three channels 18*a*, 18*b* and 18*c*. The size of the inlet 10 therefore has a diameter sufficient so that the inlet 10 is in fluid communication with all three channels 18*a*–18*c*. It will be understood, however, that a larger or small diameter inlet may be selected. If the diameter of the inlet 10 is increased, the inlet will intersect a greater number of channels thereby increasing the amount of the first heat exchange fluid which enters the plate 4.

The ends 24*a* and 24*b* of each of the channels 18*a*–18*c* on the inlet side of the plate 4 are sealed by heat sealing or filler or the like so that all of the first heat exchange fluid moves through the channels 18*a*–18*c* in the direction of the arrows "A". Accordingly, none of the first heat exchange fluid can leave the channels 18*a*–18*c* through the respective ends 24*a*, 24*b* and become intermixed with the second heat exchange fluid or solid.

As the first heat exchange fluid flows through the channels 18*a*–18*c* from the inlet 10 to the respective ends 24*b* thereof, it is caused to change direction and flow in the reverse direction through channels 18*d*, 18*e* and 18*f*. The reversal of the flow direction is accomplished by cutouts 25 provided at the ends 24*a* and 24*b* of the plate 4.

As shown best in FIGS. 2 and 5 the cutouts 25 are preferably circular having a diameter sufficient to receive the first heat exchange fluid from at least one, preferably at least two channels (three channels 18*a*–18*c* are illustrated) and to direct the fluid in the reverse direction indicated by the arrows "B" through at least one channel (three channels 18*d*–18*f* are illustrated). The ends 24*a* and 24*b* are sealed by the sealing means 19 (see FIG. 2) which may include, for example, heat sealing, filler or the like so that the first heat exchange fluid upon entering the cutouts 25 from channels 18*a*–18*c* is caused to reverse direction by 180° and flow through the next series of channels (i.e. 18*d*–18*f*) in the direction of the arrows "B" thereby providing multiple passes of the heat exchange fluid through the plates.

To prevent the first heat exchange fluid from exiting the top and/or the bottom ends of the cutout 25, there may be provided respective covers 27 made of plastic or the like over each of the cutouts 25. Referring to FIG. 5 for illustrative purposes only a single cover 27 is shown over one of the cutouts. The function of the covers may be performed by the spacers 6 as shown in FIGS. 1 and 2.

Each plate 4 is provided with a sufficient number of cutouts 25 so that the first heat exchange fluid flows back and forth through the plate 4 from the inlet 10 to the outlet 12 and eventually out of the heat exchange assembly 2.

In another embodiment of the invention, the size of inlet and outlets may be increased while still maintaining the fluid flow under an acceptably low pressure drop. As shown specifically in FIG. 6 an oversized inlet 40 is provided at one end portion 20*a* of the plate 4 and an oversized outlet 42 at the other end portion 20*b*. Since the oversized inlet 40 and outlet 42 overlaps many of the channels 18, they must be isolated from the region of active heat transfer. This is accomplished by partially isolating the inlet 40 and outlet 42 with a flow obstructor 44. The obstructor 44 may be formed by filler, heat sealing, crimping and the like. The embodiment of FIG. 6 is also provided with a series of cutouts 46 separated from the inlet 40 and outlet 42 by the obstructor 44.

Figure 6:
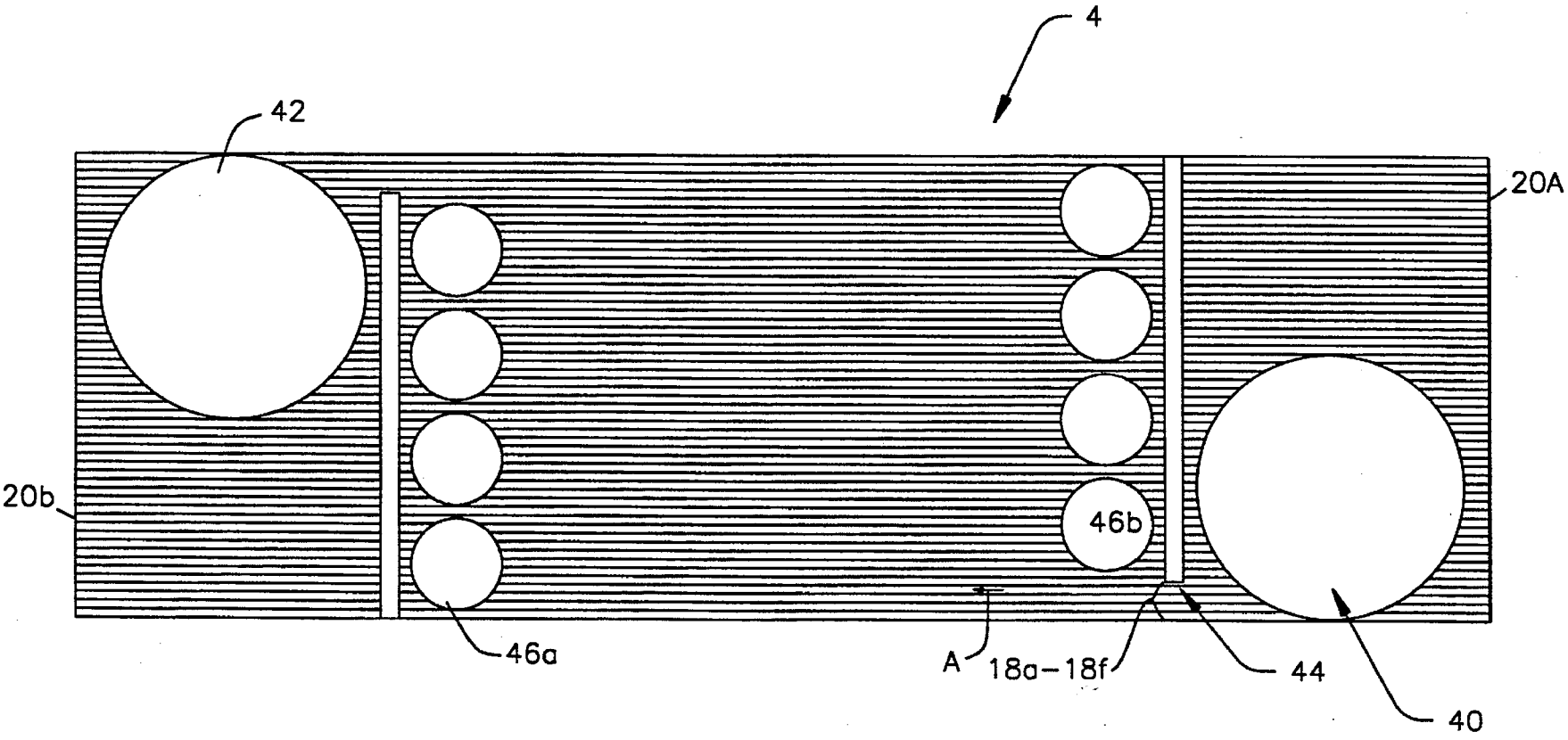
FIG. 6 is a schematic top view of a single plate for use in a heat exchange assembly with a further arrangement of the openings to provide the flow of the heat exchange fluid through the channels.

The flowpath of the first heat exchange fluid in the embodiment of FIG. 6 is as follows. The first heat exchange fluid enters through the inlet 40 where only channels 18*a*–18*f* are unsealed allowing the fluid to flow in the direction of the arrows "A". The fluid then enters the cutout 46*a*, reverses direction as described above in connection with the embodiment of FIGS. 2 and 5, and enters the cutout 46*b*. The fluid is prevented from leaving the plate 4 by the obstruction 44 until entering the outlet 42.

The first heat exchange fluids flowing in the channels which may be used in the present invention may be liquid and/or gas. The second heat exchange medium may be solids, liquid or gas. For example, a solid may be an apparatus that is capable of heat exchange with the first heat exchange fluid. The present heat exchange assembly may be used in, for example, ice storage systems, evaporative fluid coolers, liquid absorbers, vapor condensers, liquid boilers, solar panels and the like.

The heat exchange assembly may be modified to provide multiple inlets and outlets and/or to provide inlets and outlets in a variety of locations.

Figure 3:
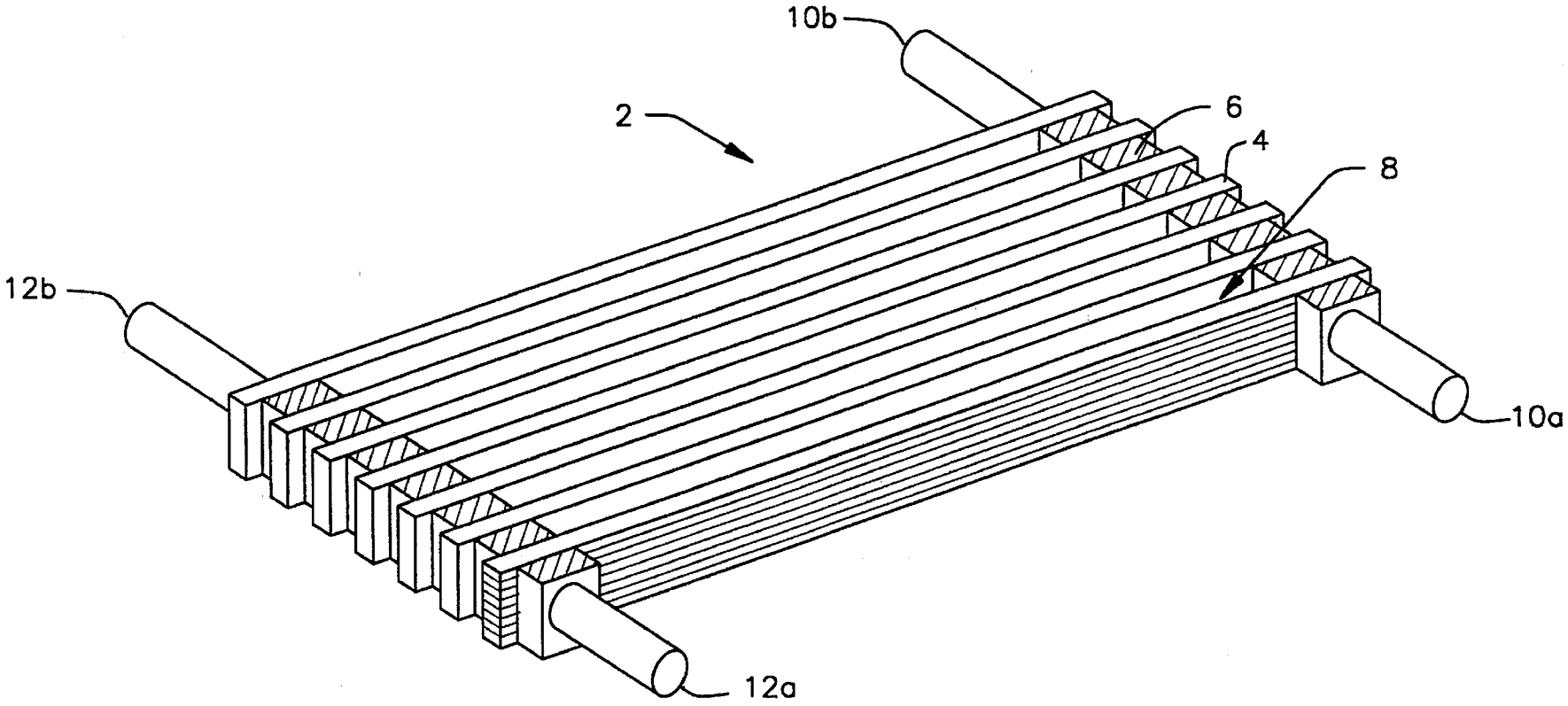
FIG. 3 is another embodiment of a heat exchange assembly of the present invention with multiple spaced-apart plates having two inlets on opposed sides of the assembly and two outlets on opposed sides of the assembly.
Figure 4:
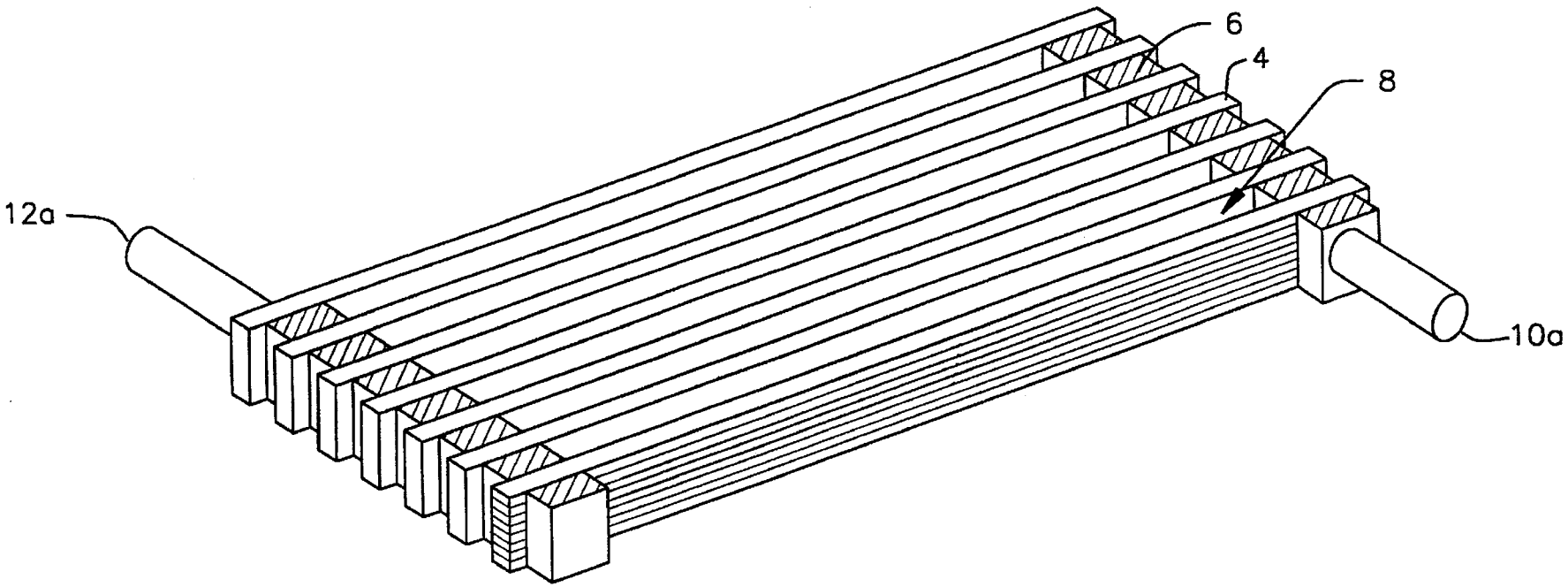
FIG. 4 is a further embodiment of a heat exchange assembly similar to FIG. 3 with one inlet and one outlet at opposed sides of the assembly.

Referring to FIG. 3 there is shown an embodiment of the invention having inlets and outlets in the front and back of the heat exchange assembly. More specifically, a first inlet 10*a* is provided on the front side of the assembly 2 and a second inlet 10*b* on the rearside. Corresponding outlets 12*a* and 12*b* are provided on opposed sides of the assembly. The first heat exchange fluid is provided to the respective inlets 10*a* and 10*b* and then flows through the channels of each plate 4 before exiting out of the respective outlets 12*a* and 12*b*. As shown in FIG. 4, a single inlet 10*a* is provided on one side of the heat exchange assembly 2 and a single outlet 12*a* on the opposed side thereof.

The embodiment shown in FIG. 3 provides lower pressure drops since the flow is split between the dual inlet and outlet. The embodiment shown in FIG. 4 is advantageous because it provides greater flexibility for certain applications.

Figure 7:
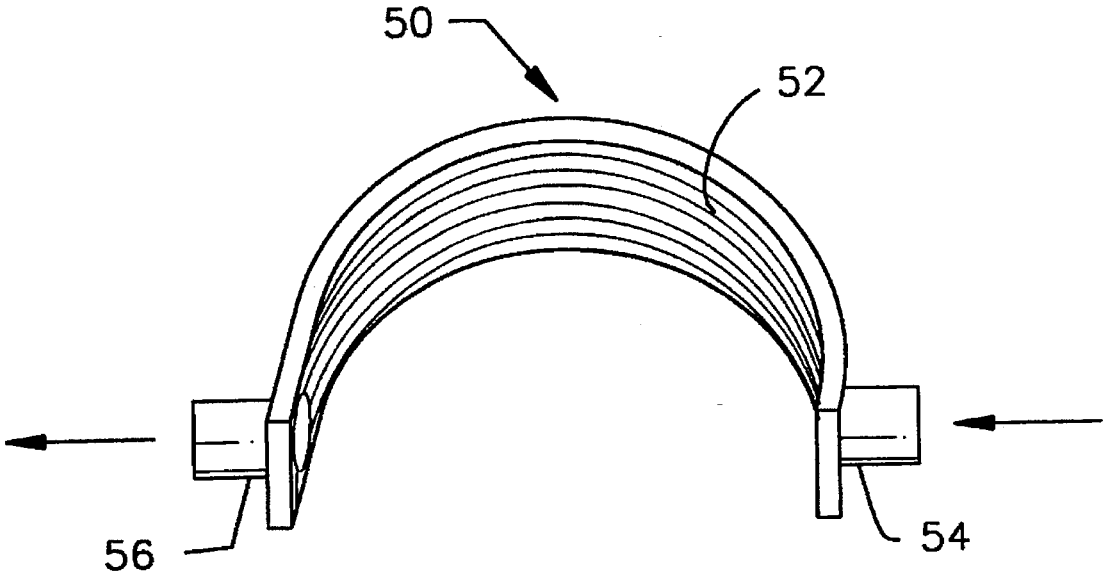
FIG. 7 is a schematic side view of another embodiment of the invention in which the plate is curved.

All of the embodiments shown if FIGS. 1–6 have plates which lie in a flat plane. As shown specifically in FIG. 7 the heat exchange assembly may include a plate which lies in a curved plane. A curved plate 50 is comprised of a plurality of channels 52 in which a heat exchange fluid enters the channel 52 through an inlet 54 and exits through an outlet 56. The curved plate design shown in FIG. 7 is particularly adapted for heat exchange with a cylindrical object such as a drum. The curved design is equally applicable to a multiple spaced-apart plate design of the type shown in FIG. 1.

EXAMPLE

A profile-board heat exchanger is made from polypropylene and is used to cool a corrosive solution of 63% (by weight) lithium bromide. The heat exchanger is similar in design and orientation to the one shown in FIG. 1 using the multipass plates shown in FIG. 5. Cooling water at 85° F. enters the heat exchanger through the inlet pipe 10. Its flow rate is 23.2 gpm. The heat exchanger contains ten spaced apart plates 4 of the type shown in FIG. 5. Each of the plates is designed so that the inlet manifold is in communication with ten internal passages or channels, each passage having a 4 mm by 4 mm cross section. The thickness of the wall that separates the water (first heat exchange fluid) and the lithium bromide (second heat exchange fluid) is 5 mil. The length of each passage is 18 inches. After traversing the length of the passages, the ten parallel flows enter a turning cut-out where they turn 180°, and then enter the next 10 internal passages on the plate. This process of (1) traversing the length of the passage, (2) turning 180° in the turning cut-out, and (3) entering the next set of 10 parallel passages continues until the flow reaches the exit manifold. The plate is designed so that the flow makes 20 passes before leaving at the exit.

The lithium bromide that is to be cooled flows upward in the spaces between the heat exchanger plates. The lithium bromide enters the heat exchanger at 160° F., and its velocity while flowing between the plates is 1 foot per second. The width of the gap between the plates is 4 mm. Since the length of the plate is 18 inches, the volumetric flow rate of the lithium bromide is calculated to be 88.4 gallons per minute (gpm).

The temperature of the lithium bromide leaving the heat exchanger is determined. This is done by the standard NTU method of calculating the performance of a heat exchanger (where NTU stands for "Number of Transfer Units"). In this method, the overall heat transfer coefficient between the hot and cold streams is first calculated. Then the NTUs for the heat exchanger are calculated by dividing the product of the overall heat transfer coefficient and the heat exchanger area by the thermal heat capacitance of the stream that experiences the largest change in temperature. Once the heat exchanger's NTUs are known, a standard formula is used to convert it into an effectiveness for the heat exchanger. Finally, the heat exchanger's effectiveness is used to calculate the temperature changes of the two streams. All calculations are done in S.I units and the final temperatures are converted into degrees Fahrenheit.

(1) Calculate the Overall Heat Transfer Coefficient

To calculate the overall heat transfer coefficient, the heat transfer coefficients of the internal flow (water) and the external flow (lithium bromide) must be known, as must the thermal impedance of the wall. The total flow of cooling water is 23.2 gallons which is equivalent to $1.463\times10^{-3}m^3/s$ based upon the use of 10 plates and the flow rate within each passage of $1.463\times10^{-5}m^3/s$. Since the cross-section of each passage is 0.004 m by 0.004 m, the velocity of the flow—which equals the volumetric flow divided by the passage cross-sectional area—is 0.91 m/s. The Reynolds number for this flow equals, $$\begin{aligned} Re &= (\text{density})*(\text{velocity})*(\text{passage dimension})/(\text{viscosity}) \\ &= (1000.0\ kg/m^3)*(0.91\ m/s)*(0.004\ m)/(0.00086\ kg/m-s) \\ &= 4254 \end{aligned}$$

At this Reynolds number, the flow within the passage is turbulent. The internal heat transfer coefficient can be calculated from the Nusselt number by the formula.

heat transfer coefficient=(Nusselt number)*(thermal conductivity)/(passage dimension)

For turbulent flow within a passage, the Nusselt number can be calculated as,

Nusselt number=0.023*(Reynolds number)$^{0.80}$*(Prandtl number)$^{0.35}$

For water the Prandtl number is about 5.85 and the thermal conductivity is 0.614 W/m-C. From the two preceding equations, the Nusselt number is calculated to be 34.14 and the heat transfer coefficient is calculated to be 5241 $W/m^2$-C.

The calculation of the heat transfer coefficient for the external flow (lithium bromide) is done in a similar manner. The total flow of lithium bromide is 88.4 gpm which is equivalent to $5.576\times10^{-3}m^3/s$. Assuming that the heat exchanger core is placed within a shell that provides a 2 mm gap between the core and the wall of the shell, there are, in effect, ten external passages between the plates, each with a 0.004 m by 0.457 m (18 in) cross section, through which the lithium bromide flows. Thus, the flow of lithium bromide within each external passage is $5.576\times10^{-4}m^3/s$. Since the velocity of the flow equals the volumetric flow divided by the passage cross sectional area, the velocity of the lithium bromide is 0.30 m/s. The density of the lithium bromide is 1742 $kg/m^3$ and its viscosity is 0.00411 kg/m-s.

The Reynolds number for the flow equals, $$\begin{aligned} Re &= (\text{density})*(\text{velocity})*(\text{passage dimension})/(\text{viscosity}) \\ &= (1742.0\ kg/m^3)*(0.30\ m/s)*(0.004\ m)/(0.00411\ kg/m-s) \\ &= 517 \end{aligned}$$

At this low Reynolds number, the flow of lithium bromide will be laminar. For all laminar flows between parallel plates, the Nusselt number is approximately 8. Since the thermal conductivity of the lithium bromide is 0.438 W/m-C, the external heat transfer coefficient is calculated as follows, $$\begin{aligned} \text{heat transfer coefficient} &= (\text{Nusselt number})*(\text{thermal conductivity})/(\text{passage dimension}) \\ &= (8)*(0.438)/(0.004) \\ &= 876\ W/m^2-C \end{aligned}$$

The overall heat transfer coefficient is calculated from the formula $$\begin{aligned} \text{overall heat transfer coefficient} &= (1.0/HTC_i + 1.0/HTC_e + t_w/k_w)^{-1} \\ &= (1.0/5241 + 1.0/876 + 0.000127/0.117)^{-1} \\ &= 413\ W/m^2-C \end{aligned}$$

where $HTC_j$ and $HTC_e$ are the internal and external heat transfer coefficients, $t_w$ is the thickness of the heat exchanger's wall (5 mil, which is equivalent to 0.000127 m), and $k_w$ is the wall's thermal conductivity (0.117 W/m-C).

(2) Calculate the NTUs for the Heat Exchanger

The NTUs for the heat exchanger are defined be the formula

NTU=(overall heat transfer coefficient),(total area)/(thermal capacitance)

where the "thermal capacitance" applies to the fluid stream that experiences the largest change in temperature and equals the product of its mass flow rate and specific heat. In this example, the cooling water will have the largest change in temperature. Its thermal capacitance will equal $$\begin{aligned} \text{thermal capacitance} &= (\text{density})*(\text{volumetric flow rate})*(\text{specific heat}) \\ &= (1000)\ kg/m3)*(1.463\times10^{-3}m^3/s)*(4180\ J/kg-C) \\ &= 6117\ W/C \end{aligned}$$

As stated above, the length of the heat transfer area on each plate is 18 in, or 0.457 m. The height of the heat transfer area will equal, $$\begin{aligned} \text{height of heat transfer area} &= (\text{height of internal passage})*(\text{number of passages in parallel})*(\text{number of passes}) \\ &= (0.004\ m)*(10)*(20) \\ &= 0.8\ m \end{aligned}$$

Since each of the ten plates has two sides that actively exchange heat, the total heat transfer area will equal $$\begin{aligned} \text{total area} &= 2*(\text{number of plates})*(\text{height})*(\text{length}) \\ &= 2*(10)*(0.8)*(0.457) \\ &= 7.315\ m^2 \end{aligned}$$

Applying the preceding formula for NTU yields, $$NTU=(413\ W/m^2-C)*(7.315\ m^2)/(6117\ W/C)=0.494$$

(3) Calculate the Effectiveness of the Heat Exchanger

Since the flow of hot lithium bromide leaves the heat exchanger core at the location where the cooling water is the coldest, the flow geometry can be described as counter-flow. For a counter-flow heat exchanger, its effectiveness as a function of NTU is, $$\text{effectiveness}=(1-\exp(NTU*(1-C)))/(1-C*\exp(1-C)))$$

where C is the ratio of the thermal capacitances of the two fluid streams (expressed so that it is less than one). The thermal capacitance for the cooling water has already been calculated to be 6117 W/C. For the lithium bromide it will be $$\begin{aligned}\text{thermal capacitance} &= (\text{density})*(\text{volumetric flow rate})*(\text{specific heat})\\ &= (1742\ \text{kg/m3})*(5.576\times10^{-3}\text{m}^3/\text{s})*(2633\ \text{J/kg}-\text{C})\\ &= 25580\ \text{W/C}\end{aligned}$$

The quantity C can now be calculated to be $$C=(6117)/(25580)=0.239$$

Entering the values for C and NTU into the preceding equation for effectiveness yields $$\begin{aligned}\text{effectiveness} &= (1-\exp(-0.494*(1-0.239)))/(1-0.239*\exp(-0.494*(1-0.239)))\\ &= 0.375\end{aligned}$$

(4) Calculate Exiting Temperatures

The effectiveness of a heat exchanger is defined by effectiveness=(actual temperature change)/(maximum possible temperature change)

where the "actual temperature change" is for the fluid that undergoes the largest temperature change. This equation for effectiveness can be rearranged to give, $$\begin{aligned}\text{water outlet temperature} &= (\text{water inlet } T)+(\text{effectiveness})*(\text{lithium bromide inlet } T-\text{water inlet } T)\\ &= (85+(0.375)*(160-85)\\ &= 113.2°\ \text{F.}\end{aligned}$$

where T is the symbol for temperature.

The outlet temperature for the lithium bromide can be calculated from an energy balance that requires that the energy gained by the cooling water must equal that lost by the lithium bromide, (water thermal capacitance)*(water T change)=(lithium bromide thermal capacitance)*(lithium bromide T change)

This expression can be rearranged as follows, lithium bromide T change=C*(water T change)

where C is the ratio of the water thermal capacitance divided by the lithium bromide thermal capacitance. It has already been calculated to be 0.239.

The lithium bromide outlet temperature is now calculated to be $$\begin{aligned}\text{lithium bromide outlet } T &= \text{lithium bromide inlet } T-\text{lithium bromide } T\text{ change}\\ &= 160°\ \text{F.}-(0.239)*(113.2°\ \text{F.}-85°\ \text{F.})\\ &= 153.3°\ \text{F.}\end{aligned}$$

We claim:

1. A heat exchange assembly comprising:

(a) at least one plate having a first end and an opposed end and comprising a plurality of channels therein for the flow of a first heat exchange fluid in a first flat or curved plane;

(b) at least one inlet and outlet for the first heat exchange fluid, said inlet and outlet being angled with respect to the first plane at the location where the inlet and outlet are in communication with the plate; and (c) flow reversing means for reversing the direction of flow of the first heat exchange fluid within the plate, said flow reversing means comprising at least one cutout spaced along one side of the plate, said cutout having a length providing flow communication with at least two channels of the plate and means at one end of the cutout changing the direction of flow of the first heat exchange fluid from the at least one channel to at least one other channel.

2. The heat exchange assembly of claim 1 comprising at least two stacked spaced-apart plates and separation means for maintaining the plates in spaced-apart relationship to provide a space for a second heat exchange fluid or solid in heat exchange relationship with the first heat exchange fluid in a second plane different than the first plane.

3. The heat exchange assembly of claim 1 wherein the inlet and outlet are angled with respect to the first plane in the range of up to 90°.

4. The heat exchange assembly of claim 3 wherein the inlet and outlet are each angled 90° with respect to the first plane.

5. The heat exchange assembly of claim 1 wherein each cutout has a length sufficient to provide flow communication with at least two channels in each direction of flow of the first heat exchange fluid.

6. The heat exchanger assembly of claim 1 comprising at least two cutouts with at least one cutout on each side of the plate wherein the first heat exchange fluid makes at least two passes through the plate from the inlet to the outlet.

7. The heat exchange assembly of claim 1 wherein the direction of flow of the first heat exchange fluid is changed by 180°.

8. The heat exchange assembly of claim 1 wherein each cutout includes cover means for preventing the first heat exchange fluid from exiting the channels.

9. The heat exchange assembly of claim 8 comprising at least two stacked spaced-apart plates and separation means for maintaining the plates in spaced-apart relationship, said separation means further comprising said cover means.

10. The heat exchange assembly of claim 1 wherein the flow reversing means comprises a plurality of cutouts on each side of the plate, a first fluid flow obstructing member between the inlet and the cutouts on one side of the plate and a second fluid flow obstructing member between the outlet and the cutouts on the other side of the plate.

11. The heat exchange assembly of claim 1 wherein each plate has a first end and an opposed end, said inlet communicating with said first end and said outlet communicating with said opposed end.

12. The heat exchange assembly of claim 1 wherein each plate has a first end and an opposed end, said inlet and outlet communicating with the first end or the opposed end.

13. The heat exchange assembly of claim 1 wherein the plate is made of profile board.

14. The heat exchange assembly of claim 1 wherein each plate has a first end, an opposed end, a plurality of inlets, and a plurality of outlets, said inlets and outlets communicating with both the first end and the opposed end of the plate.

* * * * *